United States Patent [19]

Vidueira et al.

[11] 4,401,560

[45] Aug. 30, 1983

[54] PROCESS FOR THE SEPARATION OF AROMATIC HYDROCARBONS FROM PETROLEUM FRACTIONS WITH HEAT RECOVERY

[75] Inventors: José A. Vidueira, White Plains; Paulino Forte, Yonkers; Kenneth F. Butwell, Newburgh, all of N.Y.

[73] Assignee: Union Carbide Corporation, Danbury, Conn.

[21] Appl. No.: 394,301

[22] Filed: Jul. 1, 1982

[51] Int. Cl.[3] ..... C10G 21/16

[52] U.S. Cl. ..... 208/324; 208/321; 208/333

[58] Field of Search ..... 208/324, 321, 333

[56] References Cited

U.S. PATENT DOCUMENTS

| | | | |
|---|---|---|---|
| 2,730,558 | 1/1956 | Gerhold | 208/321 |
| 3,966,589 | 6/1976 | Somekh | 208/321 |
| 4,260,476 | 4/1981 | Vidueira et al. | 208/333 |

OTHER PUBLICATIONS

John C. Olsen, "Unit Process and Principles of Chemical Engineering," D. Van Nostrand Company, Inc., New York, pp. 1-3, 1932.

*Primary Examiner*—Delbert E. Gantz
*Assistant Examiner*—Chung K. Pak
*Attorney, Agent, or Firm*—Frederick J. McCarthy, Jr.

[57] ABSTRACT

An improvement to a continuous solvent extraction-steam distillation process for the recovery of aromatic hydrocarbons in the range of $C_6$–$C_{16}$ from a feed stream containing such aromatics and aliphatic hydrocarbons in the range of $C_5$–$C_{16}$ which resides in utilizing two heat exchangers wherein the heat of condensation of the overhead stripper vapor and vapor sidedraw products is recovered and utilized to vaporize the stripping water, thereby producing stripping steam which in turn is compressed up to the pressure present at the bottom of the stripper and resulting in the reduction of the heat load of the process.

6 Claims, 1 Drawing Figure

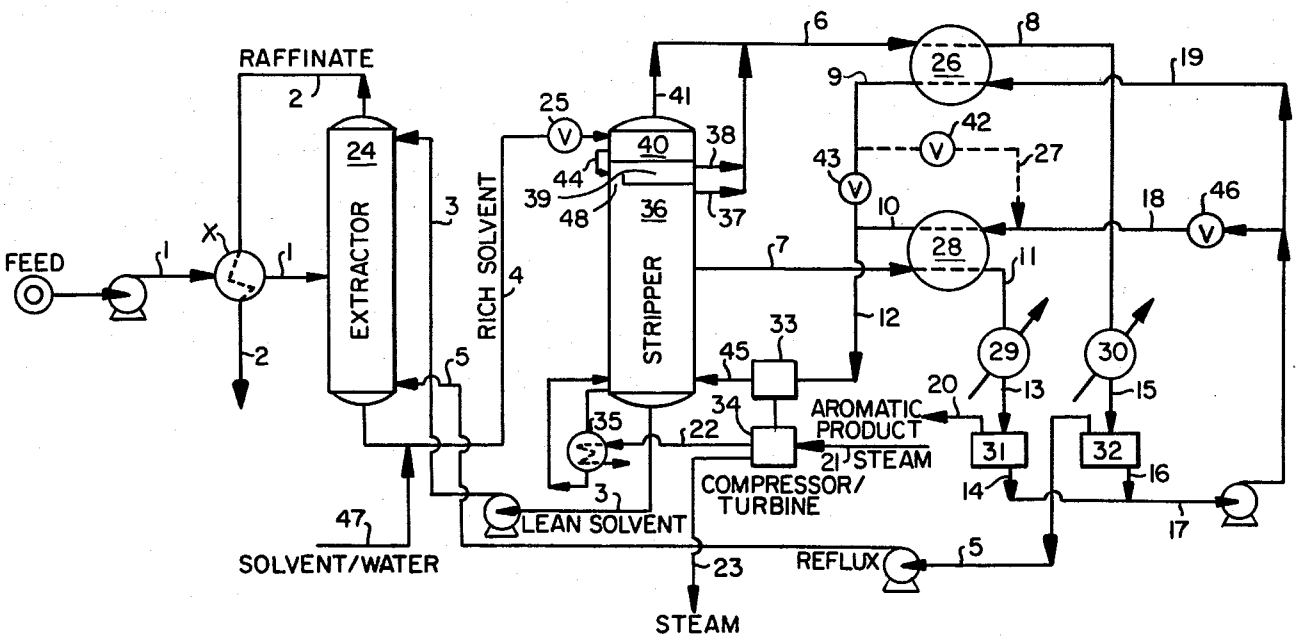
FEED
RAFFINATE
EXTRACTOR
RICH SOLVENT
STRIPPER
AROMATIC PRODUCT
STEAM
COMPRESSOR/ TURBINE
REFLUX
LEAN SOLVENT
STEAM
SOLVENT/WATER

PROCESS FOR THE SEPARATION OF AROMATIC HYDROCARBONS FROM PETROLEUM FRACTIONS WITH HEAT RECOVERY

TECHNICAL FIELD

The present invention relates to an improvement to a continuous solvent extraction-steam-distillation process for the recovery of aromatic hydrocarbons from a feed stream containing such aromatic hydrocarbons and aliphatic hydrocarbons. More particularly, this invention relates to the recovery of mixtures of benzene, toluene, xylenes (BTX) and other aromatics up to $C_{16}$ at the same purity levels required for petrochemical uses but with a significant reduction in energy consumption.

BACKGROUND

With the advent of the benzene-toluene-$C_8$ aromatics fraction (known and hereinafter referred to at BTX) as the principal raw material in the manufacture of petrochemicals, outstripping ethylene in this regard, and the increased demand for aromatics as a component in gasoline, to increase its octane rating and thus reduce or eliminate the need for lead, which has been under fire as a pollutant, aromatics processes availed of in the past have come under close scrutiny with an eye toward improving process economics, which can be translated into, among other things, the use of less apparatus and decreased heat requirements.

The recovery of aromatic hydrocarbons by selective extraction and distillation of hydrocarbon mixtures containing relatively polar compounds (aromatic and olefinic groups) and relatively less polar compounds (paraffinic and napthenic groups) is well known. A wide variety of techniques can be used. The following are typical prior art techniques:

(1) In the recovery of benzene, toluene, and $C_8$ aromatics from petroleum fractions, tetraethylene glycol is used as the selective extraction solvent. The BTX is steam distilled from the solvent which remains as bottoms and is recycled to the extraction step;

(2) In the recovery of benzene, toluene, and $C_8$ aromatics from petroleum fractions, sulfolane-water mixtures (2–4 percent water by weight) are used as the selective extraction solvent. The nonaromatics are separated from the rich solvent in a stripper at pressures that are slightly higher than atmospheric pressure. These nonaromatics are sent back to the extraction zone as reflux. The BTX is separated from the solvent in a recovery column at about 450 mm Hg. The solvent remains as bottoms and is recycled to the extraction step; and (3) Kerosenes can be treated with liquid $SO_2$ and this solvent is then distilled from the extracted aromatics.

Further examples include, Poffenberger's U.S. Pat. No. 2,711,433 which discloses an improved process for the selective solvent extraction and recovery of aromatic hydrocarbons from mixtures with non-aromatic hydrocarbons. The particular method provides for the separation and recovery of individual aromatic hydrocarbons of industrial grade or better without the need for chemical treatment. This particular patent claims heat economy, however a very complicated five column extraction-distillation process is used.

Fenske and McCormick in U.S. Pat. No. 2,909,576 disclose a method for the separation of benzene from virgin or cracked naphthas with the use of $NH_3$ as the solvent. The process operates under the theory that azeotropes of nonaromatic hydrocarbons with $NH_3$ are formed that can be separated from aromatic hydrocarbons. Though this patent claims heat recovery through the use of compressors, the pressures used are excessively high, and therefore require more expensive equipment to handle these higher pressures. Furthermore, the aromatic product obtained has low purity.

Uitti and Okuma in U.S. Pat. No. 3,367,846 claim a process for the separation of aromatic hydrocarbon mixtures of benzene, toluene and xylene utilizing fractional distillation. Low pressure columns are used in order to recover heat. The heat of condensation of the top vapors of the xylene column are employed to generate steam which is then used to operate the benzene column. This process however, proves useful only in the separation of aromatics hydrocarbons from each other.

Though these separation techniques are or have been widely used in industry, they demand a great deal of heat for the distillation steps. It is, therefore, very desirable to reduce the heat load costs in such processes.

OBJECT OF THE INVENTION

It is an object of the present invention to provide an improved method for the separation of aromatic hydrocarbons from petroleum fractions resulting in a significant reduction in energy consumption.

It is another object of the present invention to provide an improvement to an extraction-distillation process wherein the heat of condensation of the stripper overhead vapor stream and the vapor sidedraw products are recovered; this recovered heat vaporizes the stripping water thus producing stripping steam, which is then compressed up to the pressure present at the bottom of the stripper thereby reducing the heat load of the process.

SUMMARY OF THE INVENTION

The above and other objects which will be apparent to those skilled in the art are achieved by the present invention, one aspect of which relates to:

A continuous solvent extraction-steam-distillation process for the recovery of aromatic hydrocarbons in the range of $C_6$ to $C_{16}$ from a feedstock containing aliphatic hydrocarbons in the range of $C_5$ to $C_{16}$ and said aromatic hydrocarbons, comprising the following steps:

(a) contacting the feedstock with a mixture of water and solvent in an extraction zone to extract aromatics from said feedstock and producing an aromatic rich solvent while the aliphatic portion of said feedstock passes out of the top of said extraction zone as a raffinate;

(b) passing said aromatic rich solvent to a flash zone wherein said aromatic rich solvent is let down to partially vaporize said aromatic rich solvent containing hydrocarbons, water and solvent traces;

(c) passing the unvaporized portion of said aromatic rich solvent from step (b) to a second flash zone wherein said aromatic rich solvent is further let down to partially vaporize said aromatic rich solvent and to obtain an overhead vapor stream containing hydrocarbons, water and solvent traces;

(d) passing the unvaporized portion of the aromatic rich solvent from step (c) to the top of a distillation zone;

(e) contacting the unvaporized aromatic rich solvent with a stream of steam in a distillation zone to further remove remaining heavy non-aromatic components from said aromatic rich solvent;

(f) combining the overhead vapor stream from the second flash zone in step (c) with the overhead vapor stream from the first flash zone obtained in step (b);

(g) passing a vapor stream of water and hydrocarbons from the top of the distillation zone into the vaporized overhead stream from said flash zones in step (f) prior to heat exchanging such combined stream;

(h) passing said combined overhead vapor stream from step (g) to a heat exchanger;

(i) heat exchanging said combined overhead vapor stream with a stream of water;

(j) condensing the combined overhead vapor stream of step (g) and dividing the condensate into a liquid hydrocarbon rich phase and a water rich phase;

(k) passing the liquid hydrocarbon rich phase from step (j) as reflux to the bottom of said extraction zone to displace non-aromatic impurities in said aromatic rich solvent with aromatics from said reflux;

(l) passing an aromatic rich solvent stream from the distillation zone to a reboiler in a heat exchange relationship with a vapor stream of steam;

(m) passing the partially vaporized hydrocarbon stream from step (l) back into said distillation zone;

(n) contacting said aromatic rich solvent stream at the bottom of the distillation zone with steam to remove substantially all aromatic hydrocarbons from said solvent stream thereby providing a lean solvent stream which is recycled to the extraction zone in step (a);

(o) removing said aromatics, water, and small amount of impurities from step (n) as a sidedraw product;

(p) heat exchanging the aromatics, water, and small amount of impurities from step (o) with a stream of water;

(q) condensing the overhead vapor stream of step (p) and dividing the condensate into a liquid hydrocarbon rich phase and a water rich phase;

(r) combining the water rich phases from step (q) and step (j), and passing a portion of the combined water stream through the heat exchanger in step (i) and the remaining portion through the heat exchanger in step (p);

(s) compressing the water vapor stream of step (p) after heat exchange;

(t) passing said stream back into the distillation zone to provide steam for step (n);

(u) driving a turbine with steam;

(v) utilizing a portion of the superheated steam from step (u) to drive the reboiler in step (l);

(w) utilizing the remaining portion of the superheated steam from step (u) in other parts of the refinery.

An alternate preferred embodiment of the present invention comprises heat exchanging all or a substantial portion of the combined water condensate of the overhead vapor stream and the sidedraw product stream with the combined overhead vapor stream.

Another alternate preferred embodiment of the present invention comprises additionally heat exchanging the sidedraw product stream with all or a portion of the combined water condensate from the overhead vapor stream and the sidedraw product stream after said combined water stream has already been heat exchanged with the overhead vapor stream.

Another embodiment of this invention is an improvement in a continuous solvent extraction-steam-distillation process for the recovery of aromatic hydrocarbons in the range of $C_6$ to $C_{16}$ form a feedstock containing such aromatics and aliphatic hydrocarbons in the range of $C_5$ to $C_{16}$, comprises:

(a) providing a distillation zone and two flash zones;

(b) passing an aromatic rich solvent stream through said flash zones where it is let down and partially vaporized to obtain overhead vapor streams;

(c) passing the unvaporized portion of said aromatic rich solvent from step (b) to the top of the distillation zone where it is contacted with a stream of steam to further remove the remaining heavy non-aromatic copmponents from said aromatic rich solvent;

(d) combining the overhead vapor streams from the two flash zones with a vapor stream of water and hydrocarbons from the distillation zone and heat exchanging the combined stream with a stream of water;

(e) contacting the unvaporized aromatic rich solvent from step (b) with a stream of steam at the bottom of the distillation zone to remove substantially all aromatic hydrocarbons from said solvent stream;

(f) removing said aromatics, water and a small amount of impurities as a sidedraw product and heat exchanging said sidedraw product stream with a stream of water;

(g) condensing the combined overhead vapor stream in step (d) and the sidedraw product stream in step (f), respectively, after heat exchange and separating the condensates into a liquid hydrocarbon rich phase and a water rich phase;

(h) combining the water rich phases of the combined overhead vapor stream and the sidedraw product stream, thereby providing the water streams used for heat exchange in step (d) and step (f);

(i) compressing the water vapor stream of step (h) after heat exchange and recycling it to the bottom of the distillation zone to provide steam for step (e);

(j) driving a turbine with steam and utilizing a portion of the superheated steam produced from said turbine to drive a reboiler;

(k) passing an aromatic rich solvent stream from the distillation zone to the reboiler in heat exchange relationship with a vapor stream of steam from step (j);

(l) utilizing the remaining portion of the superheated steam from step (j) in other parts of the refinery.

The preferred solvent is tetraethylene glycol.

The pressure leaving the turbine should be maintained at at least 150 psia–200 psia and the preferred temperature range in the distillation zone is 247° F.–320° F.

BRIEF DESCRIPTION OF DRAWING

The sole FIGURE is a schematic flow diagram of a typical scheme for carrying out the invention. Pumps and other auxiliary equipment, which are obvious to those skilled in the art, needed to practice this invention are not shown.

DESCRIPTION OF THE PREFERRED EMBODIMENT

Referring to this drawing, a gasoline fraction that can come from a broad range of sources such as pyrolysis gasoline, reformate, coke oven light oil, kerosene, or mixtures thereof, is introduced through Conduit 1 to a Heat Exchanger X where the feed stream is typically heated to a temperature in the range of 200°-260° F. and then is introduced into Extraction Column 24 at about the midpoint. The feed flows upward and is contacted by the solvent entering Extractor 24 through Conduit 3. Extraction Column 24 typically operates at a temperature in the range of 250°-350° F. The solvent selectively extracts aromatics. The undissolved aliphatics continue flowing up the column and are removed from the top as the raffinate phase through Conduit 2. The raffinate temperature typically will be 250°-350° F. The part of Extractor 24 above the feed plate serves as the aromatics recovery section; the part below is the purification section. The raffinate is used to heat the feed in Heat Exchanger X before entering the extraction Column 24.

The aromatics-rich solvent leaves Extractor 24 through Conduit 4 and is let down through Pressure Control Valve 25, to the top of Stripper Column 36. Due to the pressure drop taking place in Pressure Control Valve 25, the aromatic rich solvent is partially and adiabatically vaporized in Flash Zones 40 and 39. The aromatic rich solvent proceeds into Flash Zone 40. Flash Zone 40 operates in the range of 30-50 psia. The liquid portion then proceeds through Conduit 44 into Flash Zone 39 where partial vaporization occurs. Flash zone 39 operates at approximately the same pressure as Stripper Column 36. A great amount of turbulence occurs in Flash Zones 40 and 39 caused by the flashing of a relatively large amount of rich solvent. Considerable entrainment of the rich solvent liquid in the vapors can take place in these sections and, therefore, a demister pad (not shown) could be installed in each section to minimize this entrainment. The vapor portions of the flashing sections consist mainly of hydrocarbons and water; they leave Flash Zones 40 and 39 through conduits 41 and 38, respectively. The liquid portions of the flashing sections, consisting of solvent, water and hydrocarbons enter the trayed sections of Stripper Column 36 through Downcomer 48 in Flash Zone 39. An extractive distillation (further aromatics purification) occurs in the upper part of Column 36. Light overhead distillate leaves Stripper Column 36 through Conduit 37 and flows into Conduit 6 where it is combined with the vapors in Conduit 41 and Conduit 38.

Stripper Column 36 is operated approximately between atmospheric pressure and 30 psia, depending upon the particular feed being processed. The lower part of Column 36 is operated as a steam distillation unit wherein stripping water (steam) is injected through Conduit 45 to remove aromatics from the solvent. The aromatics, water, and a small quantity of impurities are then withdrawn as a sidestream product from Stripper Column 36 through Conduit 7. The stripper bottoms is lean solvent which is recycled back through Conduit 3 to the top of Extractor 24.

Conduit 6 and Conduit 7 are countercurrently heat exchanged in Heat Exchangers 26 and 28 with the stripping water in Conduit 18 and Conduit 19, respectively. This stripping water, results from the cooling of the water in Conduit 8 and 11 by the water in Conduits 19 and 18 while flowing through Heat Exchangers 26 and 28, respectively. Conduit 8 is further cooled in Trim Cooler 30. The resultant condensate passes through Conduit 15 to Decanter 32 wherein two liquid layers, one hydrocarbon layer and one water layer are separated. The hydrocarbon layer is recycled through Conduit 5 to Extractor 24 as reflux. The water layer is passed to Conduit 17 through Conduit 16. The water layer in Conduit 17 then divides: part of it passing through Valve 46 into Conduit 18, and the remaining part flowing into Conduit 19.

An alternative embodiment, comprises regulating the closure of Valve 46 whereby all or a portion of the water in Conduit 17 would flow directly into Conduit 19. This alternative embodiment would prove useful, if only a small amount of sidedraw product was flowing out of Conduit 7 and into Heat Exchanger 28. In this instance, only a small quantity of heat would be produced by Stream 7 and therefore said small quantity of heat would be insufficient to vaporize a large amount of water.

Conduit 11 is further cooled in Trim Cooler 29. The resulting condensate passes through Conduit 13 and Decanter 31 wherein two liquid layers, one hydrocarbon layer and one water layer are separated. The hydrocarbon layer constitutes the aromatic product which is taken out through Conduit 20. The water layer is passed to Conduit 17 through Conduit 14. Some solvent and water is lost when the hydrocarbon layer is removed through Conduit 20 and Conduit 2. Therefore, additional solvent and water (equal to the amount lost) is added through Conduit 47 into Conduit 4.

Heat exchanging Conduits 18 and 19 (which contain stripping water) with Conduits 6 and 7, respectively, vaporizes the stripping water, using the heat of condensation of these two streams. When the stripping water is vaporized in the aforementioned manner, the rich solvent is allowed to enter the top of the Stripper Column at a higher temperature, thereby permitting the overhead vapors and sidedraw vapors to exit from this column at higher temperatures, resulting in a far more efficient recovery (lower entropy) of the heat of condensation of these two streams. After passing through Exchangers 26 and 28, respectively, Conduit 19 emerges as Conduit 9, and Conduit 18 emerges as Conduit 10. Conduit 9 then passes through Valve 43 where it is combined with Conduit 10 to form Conduit 12 which is passed to Compressor 33.

An alternative embodiment comprises regulating the closure of Valve 43 and opening Valve 42. After Conduit 9 emerges from Heat Exchanger 26 it then passes through open Valve 42 into Conduit 27 and then flows into Conduit 18. This alternative embodiment would prove useful if a large amount of sidedraw product emerged from Conduit 7. The additional water flowing from Conduit 27 into Conduit 18 could then be passed through Heat Exchanger 28 and be vaporized by the large quantity of sidedraw product emerging from Conduit 7.

Compressor 33 compresses the steam in Conduit 12 from a pressure below that of atmospheric to that pressure present at the bottom of Stripper Column 36. The outlet of Compressor 33 is passed through Conduit 45 into Stripper Column 36. Compressor 33 is driven by Turbine 34. This turbine operates through the use of superheated steam which is introduced through Conduit 21. The superheated steam is let down through Turbine 34 to a pressure low enough to drive the turbine, yet still high enough to drive Reboiler 35 and other refinery units. For example, the superheated steam can enter Turbine 34 at 650 psig, but instead of letting the pressure drop to 35 psig (saturated), where at such pressure it would be discarded because of its low "heat quality" (heat content) the steam is let down to a pressure of 150 psig (saturated), where at such pressure the steam still has good "heat quality" and can thereby be used to drive the stripper reboiler. Only a portion of the steam leaving Turbine 34 through Conduit 22 is used to drive Reboiler 35. The surplus stream is taken out through Conduit 23 and it can be used in any other part of the refinery, or chemical plant because of its high "heat quality". This portion of the steam must be used elsewhere in the refinery to obtain a net energy saving in this process. This export steam can be used, for example, in the post-fractionation train employed to separate the aromatics product into its individual constituents, namely benzene, toluene, xylene, and $C_9$+ aromatics.

Organic compounds suitable as the solvent in this process may be selected from the relatively large group of compounds characterized generally as oxygen-containing compounds, particularly aliphatic and cyclic alcohols, glycols, glycol ethers, and glycol esters. Mono- and polyalkylene glycols in which the alkylene group contains from 2 to 4 carbon atoms such as ethylene glycol, diethylene glycol, triethylene glycol and tetraethylene glycol, propylene glycol, dipropylene glycol, and tripropylene glycol, constitute a particular preferred class of organic solvents useful in admixture with water.

Other solvents suitable for use in this invention include sulfolane; N-methyl-pyrrolidone; diethanolamine; aniline; monoethanolamine; butyrolactone; 1,4, cyclohexane-dimethanol; phenol, glycerine; dimethylformide; furfural; formide; dimethyl-solfoxide; malononitrile; resorcinol, diacetin; aniardine; CARBITOL; acetamide; triacetin; xylidine; acetanilide; nitrobenzene; diaminopropanol; tricresylphosphate; benzaldehyde; triethanolamine; eugenol; diphenylamine; acetophenone; xylenol; CARBITOL acetate; butylcarbitol; phenetidine; dibutylphthalate and mixtures thereof.

The preferred solvents in the process are diethylene glycol, triethylene glycol, tetraethylene glycol or solutions thereof with water. Tetraethylene glycol is a preferred selective solvent for the present invention. It has very high selectivity, is stable, noncorrosive, and has a very high boiling point.

It is important to note that these solvents have densities above 1.1, allowing them to be used to treat petroleum fractions in conventional extraction equipment.

Extraction temperatures can range from 200° F. to 350° F. with 290° F. to 320° F. being the preferred temperature range. The choice depends upon the concentration of polar compounds in the feed, the degree of polarity of the polar compounds, product specifications and the solvent employed. Higher temperatures are needed when the concentrations of polar compounds in the feed are low, the polar compounds are low in polarity, the nonpolar product must be low in polar compounds, and the solvent contains a low carbon/oxygen ratio. The solvent/feed ratio can range from 2/1 to 12/1 by weight, 4/1 to 10/1 being preferred, and 6/1 to 8/1 being most preferred.

Conventional extraction apparatus can be used, and this includes columns containing sieve trays, packing or rotating/oscillating agitators, and mixer-settler type units. The choice depends upon the viscosity of the feedstock and solvent and the required number of theoretical stages. Staging requirements can vary from 2 to 20 theoretical stages, 3 to 15 being preferred and 4 to 12 being most preferred.

Conventional distillation apparatus can be used, and this includes columns containing sieve trays, packing, valve trays, bubble cap trays, ballast trays, etc. The choice depends upon the viscosity feedstock and solvent and the required number of theoretical stages. Staging requirements for the stripper column vary from 4 to 25 theoretical stages, 6 to 20 being preferred and 8 to 15 being most preferred.

EXAMPLE

The following data illustrates the type results that can be obtained by practicing the teachings of this invention.

Table I sets forth data obtained from computer simulations of the process contemplated by this invention versus typical prior art processes for treating a feed stream composed of about 21.95 wt. % benzene; 16.77 wt. % toluene; 18.55 wt. % hexane; 19.12 wt. % heptane; 10.48 wt. % octane; 0.13 wt. % cyclopentane; 2.06 wt. % methylcyclopentane; 0.14 wt. % methylcyclohexane. Total aromatics in the feed is 49.51 wt. %. The temperature of the feed prior to entry in the extractor is 229° F. and pressure 150 psia.

TABLE I

FEED = 49.51 WT. % AROMATICS

| | INVENTION | PRIOR ART |
|---|---|---|
| A. EXTRACTOR | | |
| 1. Number of Theoretical Trays | 12 | 12 |
| 2. Feed Trays | 9 | 9 |
| 3. Pressure, psia | 150 | 150 |
| 4. Feed Temperature, °F. | 229 | 229 |
| 5. S/F, Wt./Wt. | 5.2 | 5.2 |
| 6. R/F, Wt./Wt. | 0.9 | 0.9 |
| 7. Lean Solvent Temperature, °F. | 312 | 312 |
| B. STRIPPER COLUMN | | |
| 1. Number of Theoretical Trays | 19 | 19 |
| 2. Pressure, psia | 26.7 | 26.7 |
| 3. Flash Zone | Yes | Yes |
| 4. Temp. Entering Stripper (Top), °F. | 280 | 250 |
| 5. Temp. Overhead Vapors Leaving Stripper (Top), °F. | 247 | 220 |
| 6. Temp. Side Stream Product, °F. | 258 | 245 |
| 7. Reboiler Duty, MM Btu/Hr | 24 | 42.9 |
| 8. Stripping Water, Lbs./Hr. | 15,061 | 15,061 |
| 9. Compressor | Yes | No |

It should be noted from the above data that a heat reduction of approximately 44% was achieved with the present invention as compared to the prior art process.

We claim:

1. A continuous solvent extraction-steam-distillation process for the recovery of aromatic hydrocarbons in the range of $C_6$ to $C_{16}$ from a feedstock containing aliphatic hydrocarbons in the range of $C_5$ to $C_{16}$ and said aromatic hydrocarbons, comprising the following steps:

(a) contacting the feedstock with a mixture of water and solvent in an extraction zone to extract aromatics from said feedstock and producing an aromatic rich solvent while the aliphatic portion of said feedstock passes out of the top of said extraction zone as a raffinate;

(b) passing said aromatic rich solvent to a flash zone wherein said aromatic rich solvent is let down to partially vaporize said aromatic rich solvent and to obtain an overhead vapor stream containing hydrocarbons, water and solvent traces;

(c) passing the unvaporized portion of said aromatic rich solvent from step (b) to a second flash zone wherein said aromatic rich solvent is further let down to partially vaporize said aromatic rich solvent and to obtain an overhead vapor stream containing hydrocarbons, water and solvent traces;

(d) passing the unvaporized portion of the aromatic rich solvent from step (c) to the top of a distillation zone;

(e) contacting the unvaporized aromatic rich solvent with a stream of steam in a distillation zone to further remove remaining heavy non-aromatic components from said aromatic rich solvent;

(f) combining the overhead vapor stream from the second flash zone in step (c), with the overhead vapor stream from the first flash zone obtained in step (b);

(g) passing a vapor stream of water and hydrocarbons from the top of the distillation zone into the vaporized overhead stream from said flash zones in step (f) prior to heat exchanging such combined stream;

(h) passing said combined overhead vapor stream from step (g) to a heat exchanger;

(i) heat exchanging said combined overhead vapor stream with a stream of water;

(j) condensing the combined overhead vapor stream of step (g) and dividing the condensate into a liquid hydrocarbon rich phase and a water rich phase;

(k) passing the liquid hydrocarbon rich phase from step (j) as reflux to the bottom of said extraction zone to displace non-aromatic impurities in said aromatic rich solvent with aromatics from said reflux;

(l) passing an aromatic rich solvent stream from the distillation zone to a reboiler in a heat exchange relationship with a vapor stream of steam;

(m) passing the partially vaporized hydrocarbon stream from step (l) back into said distillation zone;

(n) contacting said aromatic rich solvent stream at the bottom of the distillation zone with steam to remove substantially all aromatic hydrocarbons from said solvent stream thereby providing a lean solvent stream which is recycled to the extraction zone in step (a);

(o) removing aromatics, water, and a small amount of impurities from step (n) as a sidedraw product;

(p) heat exchanging the aromatics, water, and small amount of impurities from step (o) with a stream of water;

(q) condensing the overhead vapor stream of step (p) and dividing the condensate into a hydrocarbon rich phase and a water rich phase;

(r) combining the water rich phases from step (q) and step (j), and then passing a portion of the combined water stream through the heat exchanger in step (i) and the remaining portion through the heat exchanger in step (p);

(s) compressing the water vapor stream of step (r) after heat exchange with a turbine driven compressor; and (t) passing said stream back into the distillation zone to provide steam for step (n);

(u) driving the turbine in step(s) with superheated steam;

(v) utilizing a portion of the superheated steam from step (u) to drive the reboiler in step (l);

(w) utilizing the remaining portion of the superheated steam from step (u) in other parts of the refinery.

2. The process of claim 1 wherein all or a substantial portion of the combined water condensate of the overhead vapor stream and the sidedraw product stream of step (r) is heat exchanged with the combined overhead vapor stream in step (i).

3. The process of claim 1 wherein all or a portion of the combined water condensate of the overhead vapor stream and the sidedraw product stream of step (r) that is heat exchanged with the overhead vapor stream in step (i) is then additionally heat exchanged with the sidedraw product stream in step (p).

4. In a continuous solvent extraction-steam-distillation process for the recovery of aromatic hydrocarbons in the range of $C_6$ to $C_{16}$ from a feedstock containing such aromatics and aliphatic hydrocarbons in the range of $C_5$ to $C_{16}$, the improvement which comprises:

(a) providing a distillation zone and two flash zones;

(b) passing an aromatic rich solvent stream through said flash zones where they are let down and partially vaporized to obtain overhead vapor streams;

(c) passing the unvaporized portion of the aromatic rich solvent from step (b) to the top of the distillation zone where it is contacted with a stream of steam to further remove the remaining heavy non-aromatic components from said aromatic rich solvent;

(d) combining the overhead vapor streams from the two flash zones with a vapor stream of water and hydrocarbons from the distillation zone and heat exchanging the combined stream with a stream of water;

(e) contacting the unvaporized aromatic rich solvent from step (b) with a stream of steam at the bottom of the distillation zone to remove substantially all aromatic hydrocarbons from said solvent stream;

(f) removing aromatics, water, and a small amount of impurities as a sidedraw product and heat exchanging said sidedraw product stream with a stream of water;

(g) condensing the combined overhead vapor stream in step (d) and the sidedraw product stream in step (f), respectively, after heat exchange, and separating the condensates into a hydrocarbon rich phase and a water rich phase;

(h) combining the water rich phases of the combined overhead vapor stream and the sidedraw product stream, thereby providing the water streams used for heat exchange in step (d) and step (f);

(i) compressing the water vapor stream of step (h) after heat exchange with a turbine driven compressor and recycling it to the bottom of the distillation zone to provide steam for step (e);

(j) driving the turbine in step (i) with superheated steam and utilizing a portion of the superheated steam produced from said turbine to drive a reboiler;

(k) passing an aromatic rich solvent stream from the distillation zone to the reboiler in heat exchange relationship with a vapor stream of steam from step (j);

(l) utilizing the remaining portion of the superheated steam from step (j) in other parts of the refinery.

5. Process according to claim 4 wherein the solvent is tetraethylene glycol.

6. Process according to claim 4 wherein the pressure leaving the turbine is maintained between 150 psia-200 psia and the distillation zone is maintained at a temperature in the range of 247° F.–320° F.

* * * * *